US008864479B2

(12) United States Patent
Watts et al.

(10) Patent No.: US 8,864,479 B2
(45) Date of Patent: Oct. 21, 2014

(54) MULTI-STAGE SCROLL MACHINE

(75) Inventors: Stephane Watts, Lyons (FR); Patrice Bonnefoi, Saint Didier au Mont D'Or (FR); Pierre Ginies, Sathonay Village (FR)

(73) Assignee: Danfoss Commercial Compressors, Reyrieux (FR)

( * ) Notice: Subject to any disclaimer, the term of this patent is extended or adjusted under 35 U.S.C. 154(b) by 196 days.

(21) Appl. No.: 13/319,440

(22) PCT Filed: Jun. 29, 2010

(86) PCT No.: PCT/FR2010/051351

§ 371 (c)(1),
(2), (4) Date: Dec. 30, 2011

(87) PCT Pub. No.: WO2011/001100

PCT Pub. Date: Jan. 6, 2011

(65) Prior Publication Data

US 2012/0100025 A1 Apr. 26, 2012

(30) Foreign Application Priority Data

Jun. 30, 2009 (FR) ..... 09 54437

(51) Int. Cl.

| | |
|---|---|
| ***F01C 1/02*** | (2006.01) |
| ***F01C 1/063*** | (2006.01) |
| ***F01C 21/00*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 23/00*** | (2006.01) |
| ***F04C 18/02*** | (2006.01) |
| *F04C 27/00* | (2006.01) |

(52) U.S. Cl.

CPC ..... *F04C 18/0276* (2013.01); *F04C 23/001* (2013.01); *F04C 18/0261* (2013.01); *F04C 23/008* (2013.01); *F04C 27/005* (2013.01)

USPC ..... 418/55.1; 418/15; 418/180

(58) Field of Classification Search

USPC ..... 418/55.1, 5–11, 54–59

See application file for complete search history.

(56) References Cited

U.S. PATENT DOCUMENTS

| | | | | |
|---|---|---|---|---|
| 4,141,677 | A | 2/1979 | Weaver et al. | |
| 4,157,234 | A * | 6/1979 | Weaver et al. | 418/6 |
| 5,346,374 | A * | 9/1994 | Guttinger | 418/6 |

(Continued)

FOREIGN PATENT DOCUMENTS

| | | |
|---|---|---|
| FR | 2 400 625 A1 | 3/1979 |
| JP | A-09-329092 | 12/1997 |

OTHER PUBLICATIONS

International Search Report issued in International Patent Application No. PCT/FR2010/051351 dated Jul. 28, 2011.

*Primary Examiner* — Kenneth Bomberg
*Assistant Examiner* — Deming Wan
(74) *Attorney, Agent, or Firm* — Oliff PLC

(57) ABSTRACT

A machine having two volute casings describing an orbital relative movement, one of the volute casings being fitted with at least one scroll and the other volute casing being equipped with at least two scrolls, the various scrolls delimiting a first series of variable-volume chambers belonging to a first compression or expansion stage, and a second series of variable-volume chambers belonging to a second compression or expansion stage, each stage having a high-pressure fluid passage and low-pressure fluid passage. A portion of the low-pressure fluid passage of the second stage is designed to open into one of the chambers of the second stage and is further away from the zone of convergence of the scrolls delimiting the variable-volume chambers of the second stage than a portion of the high-pressure fluid passage of the first stage that is designed to open into one of the chambers of the first stage.

14 Claims, 12 Drawing Sheets

(56) References Cited

U.S. PATENT DOCUMENTS 6,050,792 A * 4/2000 Shaffer ..... 418/5
6,783,338 B2 * 8/2004 Moroi et al. ..... 418/55.2
6,922,999 B2 * 8/2005 Kimura et al. ..... 60/643
2006/0099096 A1 5/2006 Shaffer et al.

* cited by examiner

MULTI-STAGE SCROLL MACHINE

The present invention relates to a multi-stage scroll machine intended to compress and/or expand a fluid.

Such a scroll machine is in particular known from document FR 2 400 625, which describes a scroll machine comprising first and second volute casings describing an orbital relative movement, the first volute casing being equipped with at least one scroll and the second volute casing being equipped with at least two scrolls, the scrolls of the second volute casing being engaged in the scroll of the first volute casing so as to delimit at least a first series of variable-volume chambers belonging to a first compression or expansion stage, and at least a second series of variable-volume chambers belonging to a second compression or expansion stage, each compression or expansion stage comprising at least one high-pressure fluid passage designed to open into one of the chambers of the respective stage and at least one low-pressure fluid passage designed to open into one of the chambers of the respective stage.

When such a machine is configured to operate as a compressor, a cooling device can be positioned between the high-pressure fluid passage of the first stage and the low-pressure fluid passage of the second stage so that the fluid compressed in the first compression stage is cooled before being conveyed toward the second compression stage.

Such a configuration makes it possible to prevent the compressed fluid discharged from the second compression stage from reaching an excessively high discharge temperature.

One drawback of this type of scroll machine lies in the fact that the compressed and cooled fluid that is conveyed in the second compression stage is heated by the compressed fluid that is discharged from the first compression stage, due to the proximity of the high-pressure fluid passage of the first stage and the low-pressure fluid passage of the second stage.

As a result, it is not easy to obtain a compressed fluid having a low discharge temperature.

Furthermore, when the fluid to be compressed is a gas, this heating of the gas to be compressed causes an increase in the temperature and enthalpy of the latter, thereby resulting in a decreased performance of the compressor.

When the machine described in document FR 2 400 625 is configured to operate as a turbine, a heating device can be arranged between the low-pressure fluid passage of the first expansion stage and the high-pressure fluid passage of the second expansion stage, so that the fluid expanded in the first expansion stage is heated before being conveyed toward the second expansion stage.

Such a configuration makes it possible to increase the mechanical energy produced by the machine.

One drawback of this type of scroll machine lies, however, in the fact that the expanded and heated fluid that is conveyed into the second expansion stage is cooled by the expanded fluid that is discharged from the first expansion stage, due to the proximity of the high-pressure fluid passage of the first stage and the low-pressure fluid passage of the second stage.

As a result, the efficiency of the scroll machine is not optimal.

Furthermore, the scroll machine described in document FR 2 400 625 comprises a first stage extending from the outer end of the scroll of the fixed volute casing toward the inner end of the scroll thereof, and a second stage extending in the continuation of the first stage as far as the inner end of the scroll of the fixed volute casing.

Such a configuration of the two stages has the result that the possibilities for adjusting the displacement of the second stage are limited.

Furthermore, a significant compression rate of the first stage can only be obtained at the expense of a significant number of scroll turns.

The present invention aims to resolve all or part of these drawbacks.

The technical problem at the base of the invention therefore consists of providing a multi-stage scroll machine having a simple, economical structure and making it possible to improve the performance thereof, and allowing easy adjustment of the displacements and the compression or expansion rates of the different compression or expansion stages.

To that end, the invention relates to a multi-stage scroll machine intended to compress and/or expand a fluid, comprising first and second volute casings describing an orbital relative movement, the first volute casing being equipped with at least one scroll and the second volute being equipped with at least two scrolls, the scrolls of the second volute casing being engaged in the scroll of the first volute casing so as to delimit at least a first series of variable-volume chambers belonging to a first compression or expansion stage, and at least one second series of variable-volume chambers belonging to a second compression or expansion stage, each compression or expansion stage comprising at least one high-pressure fluid passage arranged to open into at least one of the chambers of the respective stage and at least one low-pressure fluid passage arranged to open into at least one of the chambers of the respective stage, the high-pressure fluid passage of the first stage and the high-pressure fluid passage of the second stage being configured so that the fluid passing through the high-pressure fluid passage of the first stage has a lower pressure than that of the fluid passing through the high-pressure fluid passage of the second stage, characterized in that the portion of the low-pressure fluid passage of the second stage arranged to open into at least one of the chambers of the second stage is further from the convergence zone of the scrolls delimiting the variable-volume chambers of the second stage than the portion of the high-pressure fluid passage of the second stage arranged to open into at least one of the chambers of the first stage.

Such positioning of the low-pressure fluid passage of the second stage significantly increases the possibilities for adjusting the displacement and the compression or expansion rate of the different stages, since it is no longer necessary to position the two stages one in the extension of the other.

As a result, depending on the intermediate heating or cooling process, it is possible, in order to improve the effectiveness and performance of the machine, to adjust the displacements and the compression or expansion rates of the two stages simply by adapting the positioning of the low-pressure fluid passage of the second stage.

Such positioning of the low-pressure fluid passage of the second stage also makes it possible to move the latter away from the high-pressure fluid passage of the first stage, and therefore to avoid a heat transfer between the fluids flowing through these two fluid passages. These arrangements make it possible to increase the mechanical energy produced by the machine when the latter operates as a turbine, and to easily obtain a compressed fluid having a low discharge temperature when the machine operates as a compressor.

It should be noted that the high-pressure fluid passage belonging to a first compression or expansion stage can have a pressure substantially equal to that of the low-pressure fluid passage belonging to the second compression or expansion stage, or a pressure substantially equal to that of the high-pressure fluid passage belonging to the second compression or expansion stage.

Preferably, each scroll of a same volute casing extends from a same side of said volute.

Advantageously, the scrolls of the second volute overlap one another so that, according to at least one radial cross-section of the second volute casing, at least one alternation of the scrolls of the second volute casing is achieved from the convergence zone of the scrolls of the second volute casing. It should be noted that the convergence zone of the scrolls of the second volute casing corresponds to the zone where the inner ends of these scrolls would converge if the latter were extended to their origin.

It must be noted that the term "alternation of the scrolls of the second volute casing" must be interpreted as meaning that one successively encounters at least one first scroll of the second volute casing, a second scroll of the second volute casing and again the first scroll of the second volute casing.

Preferably, the variable-volume chambers of at least one of the stages have a different height from that of the variable-volume chambers of the other stages. Advantageously, at least one of the scrolls of the second volute casing has a different height from that of the other scrolls of the second volute casing. Preferably, each scroll of the second volute casing has a different height from that of the other scrolls of the second volute casing. These arrangements also make it possible to adjust the displacement of the second stage. Thus, the adjustment of the displacement of the second stage is done primarily by adapting the position of the low-pressure fluid passage of the second stage, and secondarily by adjusting the relative height of the variable-volume chambers of each stage.

Advantageously, when the mass flows seen by the different stages are identical (typical case of an intermediate process simply consisting of cooling or heating the fluid), the height of the scroll of the second volute casing partially delimiting the variable-volume chambers of the first stage is larger than the height of the scroll of the second volute casing partially delimiting the variable-volume chambers of the second stage.

Preferably, when the mass flow of the second stage is lower than the mass flow of the first stage (typical case of an intermediate process with fluid removal in compressor operation), the height of the scroll of the second volute casing partially delimiting the variable-volume chambers of the first stage is larger than the height of the scroll of the second volute casing partially delimiting the variable-volume chambers of the second stage.

When the mass flow of the second stage is greater than the mass flow of the first stage (typical case of an intermediate process with fluid injection in compressor mode), the height of the scroll of the second volute casing partially delimiting the variable-volume chambers of the first stage is advantageously smaller than the height of the scroll of the second volute casing partially delimiting the variable-volume chambers of the second stage.

Preferably, the volute casing and one of the scrolls of the second volute casing are configured so that axial play exists between the latter parts, and said scroll of the second volute casing includes, on its face oriented toward the first volute casing and on at least a portion of its length, a sealing segment. The sealing between the apex of the other scrolls and the surface of the opposite volute casing is obtained by contact monitoring.

According to one alternative embodiment of the invention, at least one of the scrolls of the second volute casing has a different thickness from that of the other scrolls of the second volute casing. Preferably, each scroll of the second volute casing has a different thickness from that of the other scrolls of the second volute.

According to another alternative embodiment of the invention, at least one of the scrolls of the second volute casing has a longitudinally variable thickness. These arrangements make it possible on the one hand to reduce the number of turns of the scrolls necessary for a given compression rate, and on the other hand to produce a housing in one of the scrolls of one of the volute casings arranged to receive one of the scrolls of the other volute casing.

Advantageously, the machine comprises connecting means arranged to connect the high-pressure fluid passage of the first stage and the low-pressure fluid passage of the second stage, on the one hand, and heating and/or cooling means arranged to heat and/or cool the fluid flowing between the high-pressure fluid passage of the first stage and the low-pressure fluid passage of the second stage, on the other hand.

Advantageously, the scroll machine comprises:

a sealed enclosure delimited by a shroud whereof the upper and lower ends are closed by a lid and a base, respectively, a body on which the mobile volute body bears, an electric motor surrounded by a tubular jacket defining an intermediate chamber with the body, a connector extending through an opening formed in the shroud and opening into the intermediate chamber, the connector being connected to the heating and/or cooling means, and at least one fluid circulation passage connecting the part of the scroll machine housing the motor to a chamber delimited by the fixed volute casing and the lid According to a first alternative, the low-pressure fluid passage belonging to the second compression or expansion stage opens into the chamber delimited by the lid and the fixed volute casing, and the high-pressure fluid passage belonging to the first compression or expansion stage is directly connected to a connector extending through an opening formed in the lid, said connector being connected to the heating and/or cooling means.

According to a second alternative, the low-pressure fluid passage belonging to the second compression or expansion stage is connected directly to a connector extending through an opening formed in the lid, said connector being connected to the heating and/or cooling means, and the high-pressure fluid passage belonging to the first compression and/or expansion stage opens into the chamber delimited by the lid and the fixed volute casing.

According to one embodiment of the invention, the scroll machine is a scroll compressor, the low-pressure fluid passages of the different stages are fluid intake passages, the high-pressure fluid passages of the different stages are fluid discharge passages, and the fluid is intended to be compressed successively in the first stage and in the second stage.

Preferably, the scroll compressor comprises a coolant inlet opening into an intake chamber formed in the body and communicating with a suction chamber delimited by the fixed and mobile volute casings. Advantageously, when the high-pressure fluid passage belonging to the first compression or expansion stage is directly connected to a connector extending through an opening formed in the lid, said connector forms a coolant outlet, and when the low-pressure fluid passage belonging to the second compression or expansion stage is directly connected to a connector, said connector forms a coolant inlet.

Preferably, at least one of the stages comprises two variable-volume chambers, called outer chamber and inner chamber, delimited inwardly and outwardly, respectively, by one of the scrolls of the second volute casing and arranged to open into the high-pressure fluid passage of the corresponding stage, and the machine comprises pressure balancing means configured so that the pressure in the outer chamber, before it is put in communication with the high-pressure fluid passage of the corresponding stage, is substantially equal to the pressure in the inner chamber before it is put in communication with the high-pressure fluid passage of the corresponding stage.

Advantageously, the pressure balancing means include a protrusion extending from the inner surface of the scroll of the first volute casing and situated at the high-pressure fluid passage of the corresponding stage, the protrusion preferably having a profile arranged to delay the placement of the outer chamber in communication with the high-pressure fluid passage of the corresponding stage. The profile of the protrusion is advantageously the profile conjugated with that of the inner end of the scroll of the second volute casing delimiting the outer and inner chambers. Preferably, the protrusion has an arc-of-circle profile with a radius equal to the orbit radius of the orbital movement.

Advantageously, the outer end of the scroll of the first volute casing and the outer end of the scroll of the second volute casing partially delimiting the variable-volume chambers of the first stage are situated asymmetrically relative to the convergence zone of the scrolls delimiting the variable-volume chambers of the second stage, and the balancing means include a portion of the scroll of the first volute casing extending between a point diametrically opposite the outer end of the scroll of the second volute casing partially delimiting the variable-volume chambers of the first stage relative to the convergence zone of the scrolls delimiting the variable-volume chambers of the second stage and the outer end of the scroll of the first volute casing.

Preferably, each scroll of the second volute casing partially delimits the variable-volume chambers of a single stage.

According to another embodiment of the invention, the scroll machine is a scroll expansion machine, the low-pressure fluid passages of the different stages are fluid discharge passages, the high-pressure fluid passages of the different stages are fluid intake passages, and the fluid is intended to be expanded successively in the second stage and in the first stage.

Preferably, the first volute casing is fixed and the second volute casing is mobile.

In any event, the invention will be well understood using the following description in reference to the appended diagrammatic drawing showing, as a non-limiting example, two embodiments of this scroll machine.

Figure 1:
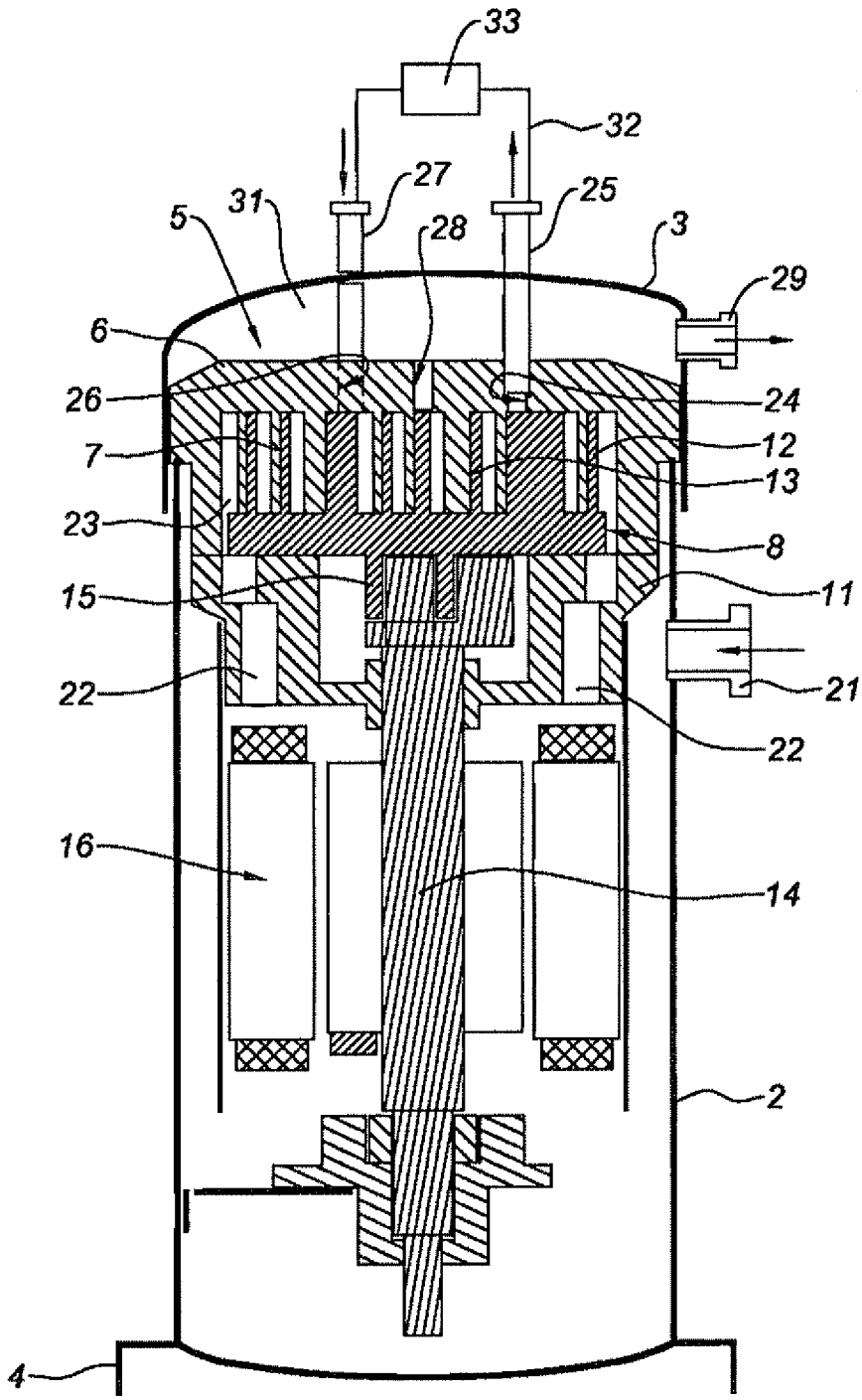
FIG. 1 is a diagrammatic longitudinal cross-sectional view of a scroll machine according to a first embodiment.

FIGS. 1 to 4 show a multi-stage scroll machine, according to a first embodiment of the invention, configured to operate as a compressor arranged to compress a coolant. FIG. 1 describes a scroll machine in a vertical position. However, the scroll machine according to the invention could be in a tilted position, or a horizontal position, without its structure being significantly modified.

The scroll machine shown in FIG. 1 comprises a sealed enclosure delimited by a shroud 2 whereof the upper and lower ends are respectively closed by a lid 3 and a base 4. The assembly of this enclosure can in particular be done using welding seams.

The scroll machine comprises a fixed volute casing 5 including a plate 6 equipped with a scroll 7 intended to face downward, and a mobile volute casing 8 including a plate 9 bearing against a body 11 contained in the jacket of the scroll machine, the plate 9 being equipped with two scrolls 12, 13 intended to face upward.

The scroll machine comprises a drive shaft 14 whereof the upper end is engaged in a sleeve-shaped portion 15, included in the mobile volute casing 8. When rotated by an electric motor 16 contained in the jacket of the scroll machine, the drive shaft 14 drives the mobile volute casing 8 following a circular orbital movement relative to the fixed volute casing 5.

Figure 2:
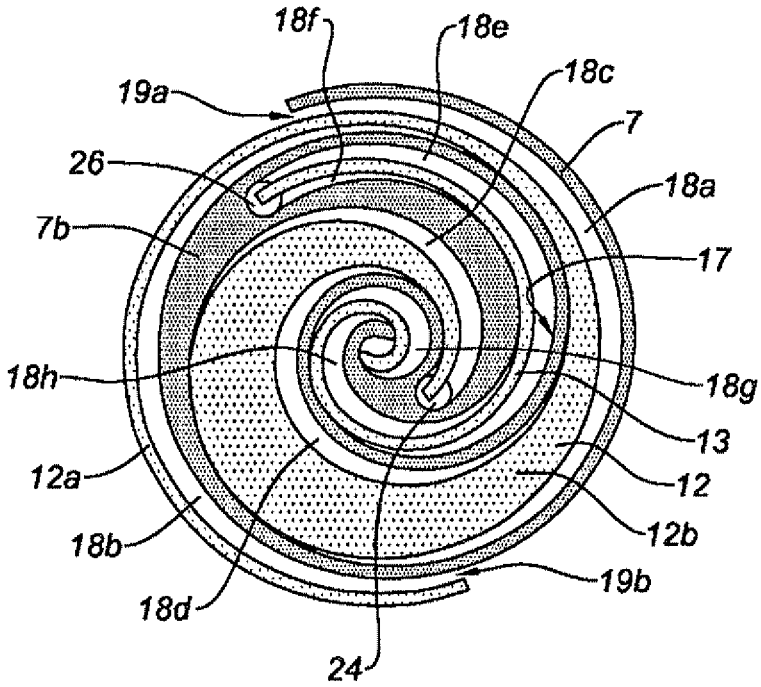
FIGS. 2 and 3 are transverse cross-sectional views of the machine of FIG. 1 showing the scrolls of the fixed and mobile volute casings in two distinct operating positions.

As shown in FIG. 2, the scroll 12 of the mobile volute casing 8 has a longitudinally variable thickness. The scroll 12 of the mobile volute casing 8 has a first portion 12*a* with a constant thickness extending from its outer end, and a second portion 12*b* with a variable thickness extending in the continuation of the first portion 12*a* and as far as the inner end of the scroll 12.

The scroll 13 of the mobile volute casing 8 has a constant thickness.

It should be noted that the scrolls 12, 13 of the mobile volute casing 8, if they were extended as far as their origin, would converge toward a convergence zone situated substantially at the center of the mobile volute casing 8.

The scrolls 12, 13 of the mobile volute casing 8 overlap one another so that, according to at least one radial cross-section of the mobile volute casing 8, one encounters, from the convergence zone of the scrolls 12, 13, the scrolls 12, 13, alternatingly, of the mobile volute casing 8.

The scroll 7 of the fixed volute casing 5 has a longitudinally variable thickness. The scroll 7 of the fixed volute casing 5 has a first portion 7*a* with a constant thickness extending from its outer end, and a second portion 7*b* with a variable thickness extending in the continuation of the first portion 7*a* and as far as the inner end of the scroll 7.

The second portion 7*b* of the scroll 7 of the fixed volute casing comprises a housing 17 extending in a scroll arranged to receive the scroll 13 of the mobile volute casing 8.

Figure 4:
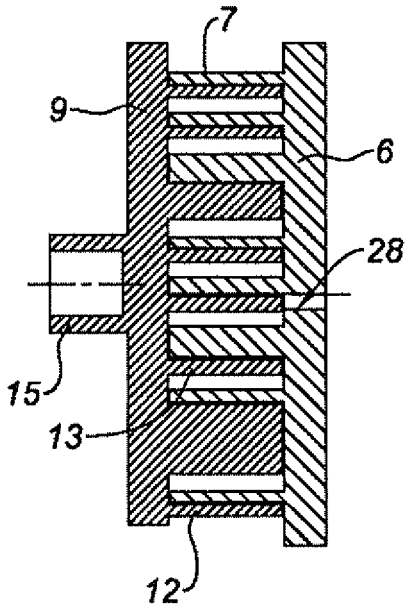
FIG. 4 is a cross-sectional view along line A-A of FIG. 3.

As shown in FIG. 4, the scrolls 12, 13 of the mobile volute casing 8 and the scroll 7 of the fixed volute casing have an identical height.

The scrolls 12, 13 of the mobile volute casing 8 are engaged in the scroll 7 of the fixed volute casing 5 so as to delimit a first series of variable-volume chambers 18*a* to 18*d* belonging to a first compression stage, and a second series of variable-volume chambers 18*e* to 18*h* belonging to a second compression stage.

The scroll 12 of the mobile volute casing 8 partially delimits only the variable-volume chambers 18*a* to 18*d* belonging to the first compression stage, while the scroll 13 of the mobile volute casing 8 partially delimits only the variable-volume chambers 18*e* to 18*h* belonging to the second compression stage.

Each compression stage comprises pairs of variable-volume compression chambers respectively delimited inwardly and outwardly by one of the scrolls of the mobile volute casing 8, the compression chambers having a volume that decreases gradually from the outside in during the orbital movement of the mobile volute casing 8.

It should be noted that the scroll 7 of the fixed volute casing 5 and the scroll 13 of the mobile volute casing 8 converge toward a convergence zone situated substantially at the center of the fixed volute casing.

The outer end of the scroll 7 of the fixed volute casing 5 and the outer end of the scroll 12 of the mobile volute casing 8 are situated symmetrically relative to the convergence zone of the scrolls 7, 13 delimiting the variable-volume chambers of the second stage.

The first compression stage comprises two fluid intake passages 19*a*, 19*b* connected to a coolant inlet 21 formed radially in the shroud 2 via two intake channels 22 formed in the body 11, on the one hand, and a suction chamber 23 delimited by the fixed 5 and mobile 8 volute casings and communicating with the two intake channels 22, on the other hand.

The fluid intake passage 19*a* is delimited by a space between the outer end of the scroll 7 of the fixed volute casing 5 and the outer wall of the scroll 12 of the mobile volute casing 8. The fluid intake passage 19*b* is delimited by a space between the outer end of the scroll 12 of the mobile volute casing 8 and the outer wall of the scroll 7 of the fixed volute casing 5.

The fluid intake passages 19*a*, 19*b* are arranged to emerge respectively in the outermost variable-volume chambers of the first stage (chambers 18*a* and 18*b* in FIG. 2) during the orbital movement of the mobile volute casing 8.

The first compression stage also comprises a fluid discharge passage 24 arranged to open respectively into the innermost variable-volume chambers of the first stage (chambers 18*c*, 18*d* in FIG. 2) during the orbital movement of the mobile volute casing 8.

The fluid discharge passage 24 of the first stage is formed by a through orifice formed in the plate 6 of the fixed volute casing 5 and opening at the inner end of the scroll 12 of the mobile volute casing 8. The through orifice 24 is directly connected to a coolant outlet 25 formed in the lid 3. The coolant outlet 25 advantageously extends parallel to the axis of the machine.

The second compression stage comprises a fluid intake passage 26 connected to a coolant inlet 27 formed in the lid 3 and arranged to open respectively into the outermost chambers of the second stage (chambers 18*e* and 18*f* in FIG. 2) during the orbital movement of the mobile volute casing 8.

The second compression stage also comprises a fluid discharge passage 28 arranged to open respectively into the innermost chambers of the second stage (chambers 18*g* and 18*h* in FIG. 2) during the orbital movement of the mobile volute casing 8.

The fluid intake passage 26 is formed by a through orifice formed in the plate 6 of the fixed volute casing 5 and opening at the outer end of the scroll 13 of the mobile volute casing 8. The fluid discharge passage 28 of the second stage is formed by a through orifice formed in the plate 6 of the fixed volute casing 5 and emerging at the inner end of the scroll 13 of the mobile volute casing 8. The through orifice 28 is connected to a coolant outlet 29 radially formed in the lid 3 via a discharge chamber 31 delimited by the lid 3 and the fixed volute casing 5.

Preferably, the intake 26 and discharge 28 orifices of the second stage and the discharge orifice 24 of the first stage extend substantially perpendicular to the plate 6 of the fixed volute casing 5.

As shown in FIG. 2, the fluid intake orifice 26 of the second compression stage is further from the center of the fixed volute casing 5 than the discharge orifice 24 of the first compression stage. It should also be specified that the fluid intake orifice 26 of the second compression stage is further from the convergence zone of the scroll 7 of the fixed volute casing 5 and the scroll 13 of the mobile volute casing 8 than the discharge orifice 24 of the first compression stage.

The scroll machine also comprises connecting means arranged to connect the fluid discharge passage 24 of the first stage to the fluid intake passage 26 of the second stage, and on the other hand the cooling means 33 arranged to cool the fluid flowing from the fluid discharge passage 24 of the first stage to the fluid intake passage 26 of the second stage. The connecting means include, according to the embodiment shown in FIG. 1, the coolant outlet 25, the coolant inlet 27 and two connecting portions 32 respectively connecting the coolant outlet 25 to the cooling means 33 and the coolant inlet 27 to the cooling means 33.

The operation of the scroll machine will now be described.

Figure 3:
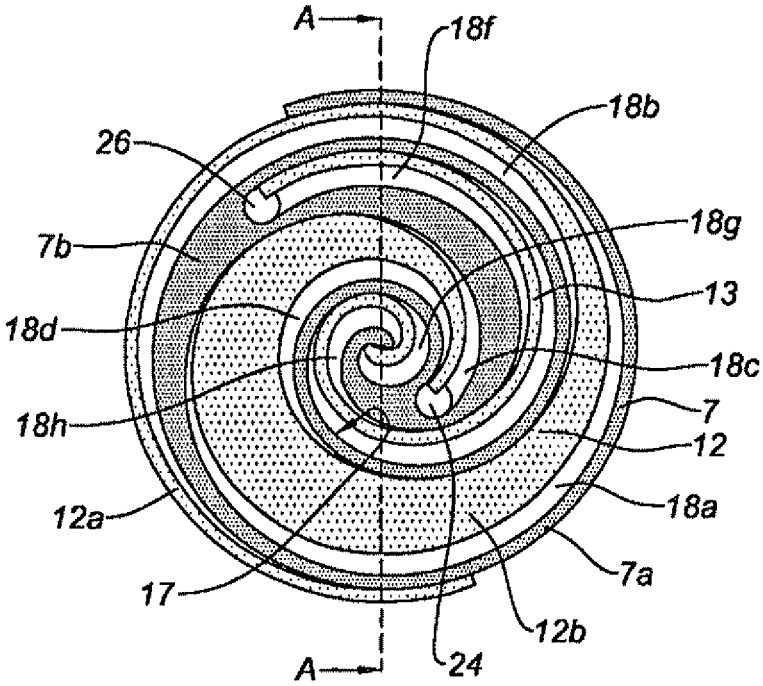

FIG. 3 shows a position of the fixed 5 and mobile 8 volute casing in which the two outer compression chambers of the first compression stage are respectively closed at the outer ends of the scrolls 7 and 12. This position of the fixed 5 and mobile 8 volute casing corresponds to the so-called "displacement" position.

Once the mobile volute casing 8 moves from the position shown in FIG. 3, the outer chambers of the first stage move toward the inside in the clockwise direction and their capacity decreases, which causes a compression of the coolant contained in the latter parts. When these two outer chambers reach the discharge orifice 24, the coolant contained in the latter parts is discharged through said discharge orifice 24 and is transported to the cooling means 33 via the coolant outlet 25 and one of the connecting portions 32.

The compressed coolant is cooled and is then transported to the intake orifice 26 of the second stage via the other connecting portion 32 and the coolant inlet 27, so it can be compressed in the variable-volume chambers of the second stage and so it can be discharged through the discharge orifice 28 formed substantially at the center of the fixed volute casing 5.

Figure 5:
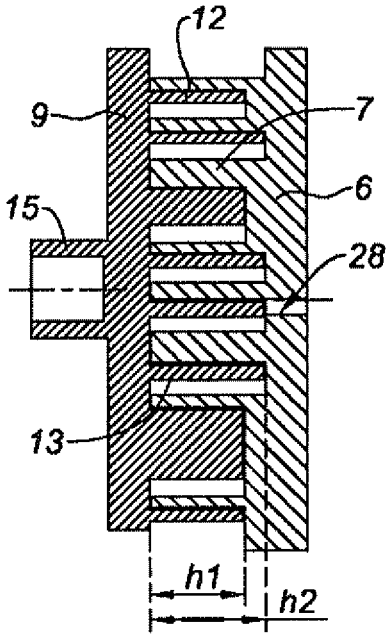
FIG. 5 is a longitudinal cross-sectional view of the fixed and mobile volute casings of a scroll machine according to a second embodiment.

FIG. 5 shows an alternative embodiment of the scroll machine that differs from that shown in FIG. 1 in that the scroll 13 of the mobile volute casing 8 has a height h2 greater than the height h1 of the scroll 12 of the mobile volute casing 8 so that the variable-volume chambers belonging to the second compression stage have a height greater than that of the variable-volume chambers belonging to the first compression stage.

Figure 6:
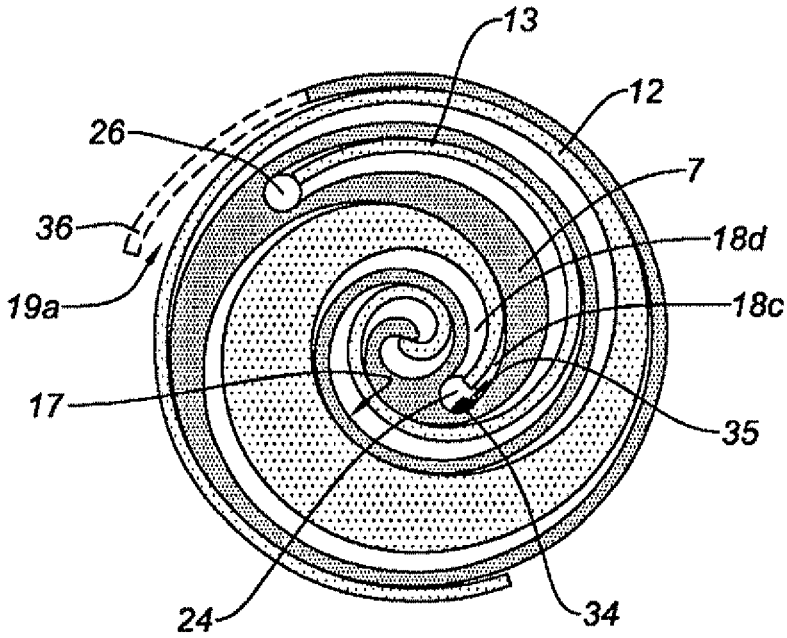
FIG. 6 is a transverse cross-sectional view of a scroll machine according to a third embodiment.

FIG. 6 shows an alternative embodiment of the scroll machine that differs from that shown in FIG. 1 in that it also comprises pressure balancing means configured so that the pressure in the variable-volume chamber 18*c* before it is put in communication with the fluid discharge passage 24 of the first stage is substantially equal to the pressure in the variable-volume chamber 18*d* before it is put in communication with the fluid discharge passage 24 of the first stage.

The balancing means include a protrusion 34 extending from the inner surface of the scroll 7 of the fixed volute casing 5 and situated at the fluid discharge passage 24 of the first stage. The protrusion 34 has an arc-of-circle profile 35 arranged to delay the placement of the variable-volume chamber 18*c* in communication with the fluid discharge passage 24 of the first stage.

As shown in broken lines in FIG. 6, the outer end of the scroll 7 of the fixed volute casing and the outer end of the scroll 12 of the mobile volute casing could be situated substantially asymmetrically relative to the convergence zone of the scrolls 7, 13 delimiting the variable-volume chambers of the second stage. According to this embodiment, the balancing means would also be made up of a portion 36 of the scroll 7 extending between a point diametrically opposite the outer end of the scroll 12 of the mobile volute casing relative to the convergence zone of the scrolls 7, 13 and the outer end of the scroll 7 of the fixed volute casing.

Figure 7:
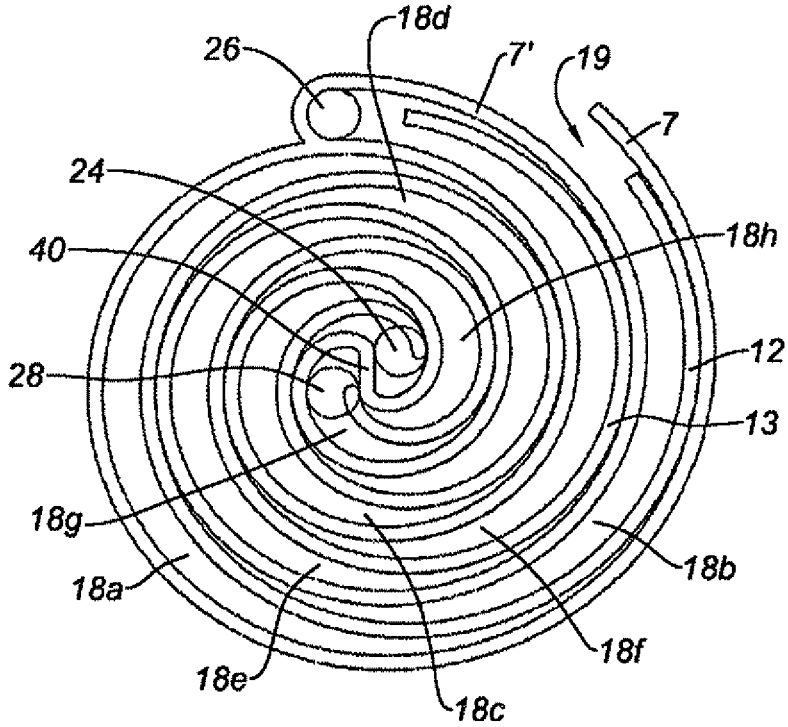
FIG. 7 is a transverse cross-sectional view of the fixed and mobile volute casings of a scroll machine according to a fourth embodiment.

FIG. 7 shows another alternative embodiment of the scroll machine that differs from that shown in FIG. 1 essentially in that the fixed volute casing 5 comprises two scrolls 7, 7' overlapping one another and the inner ends of which are connected to one another by a partition 40, in that the scrolls 12, 13 of the mobile volute casing 8 have an identical constant thickness, and in that the first stage includes only one fluid intake passage 19.

The fluid intake passage 19 is delimited by the outer end of the scroll 7 of the fixed volute casing 5 and the outer wall of the scroll 7' of the fixed volute casing 5, and is arranged to open respectively into the outermost variable volute chambers of the first stage (chambers 18*a* and 18*b* in FIG. 7) during the orbital movement of the mobile volute casing.

The scrolls 7, 7' of the fixed volute casing 5 overlap one another so that, according to a radial cross-section of the fixed volute casing 5, one encounters, from the convergence zone of the scrolls 7, 7', alternatively the scrolls 7, 7' of the fixed volute casing 5. The scrolls 7, 7' of the fixed volute casing 5 have an identical constant thickness.

The outer end of the scroll 7' of the fixed volute casing 5 is connected to the outer wall of the scroll 7 of the fixed volute casing 5 at the intake orifice 26 of the second stage.

The scrolls 12, 13 of the mobile volute casing 8 are engaged in the scrolls 7, 7' of the fixed volute casing 5 so as to delimit a first series of variable-volume chambers 18*a* to 18*d* belonging to a first compression stage, and a second series of variable-volume chambers 18*e* to 18*h* belonging to a second compression stage.

Figure 8:
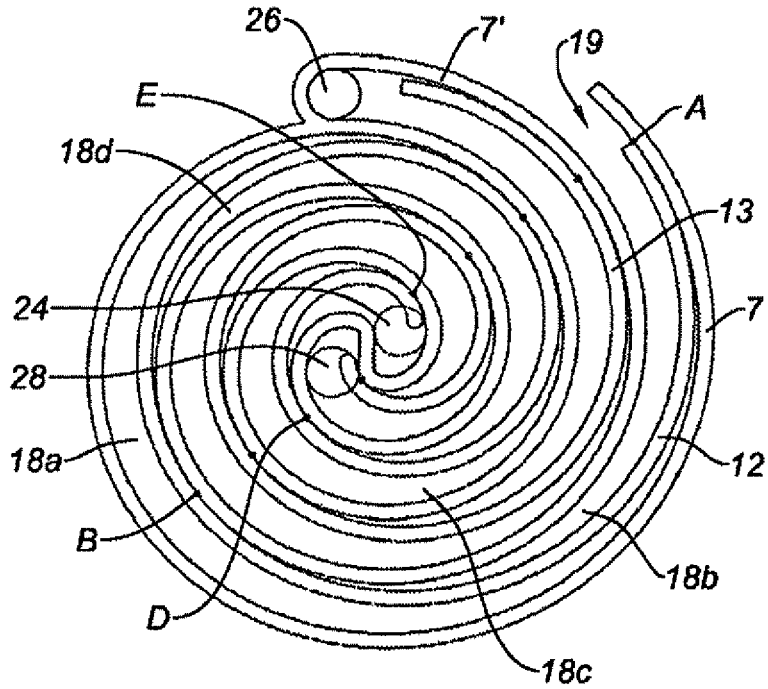
FIGS. 8 to 11 are transverse cross-sectional views of the volute casings of FIG. 7, in four distinct operating positions respectively offset by a quarter revolution.

FIG. 8 shows the scrolls of the fixed and mobile volute casings of FIG. 7 in angular positions such that the outer end of the scroll 12 of the mobile volute casing 8 defines a sealing line of one of the chambers of the first stage.

Points A to E shown in FIG. 8 show the sealing lines between the scroll 12 of the mobile volute casing 8 and the scrolls of the fixed volute casing 5, these sealing lines defining the variable-volume chambers of the first stage.

Figure 9:
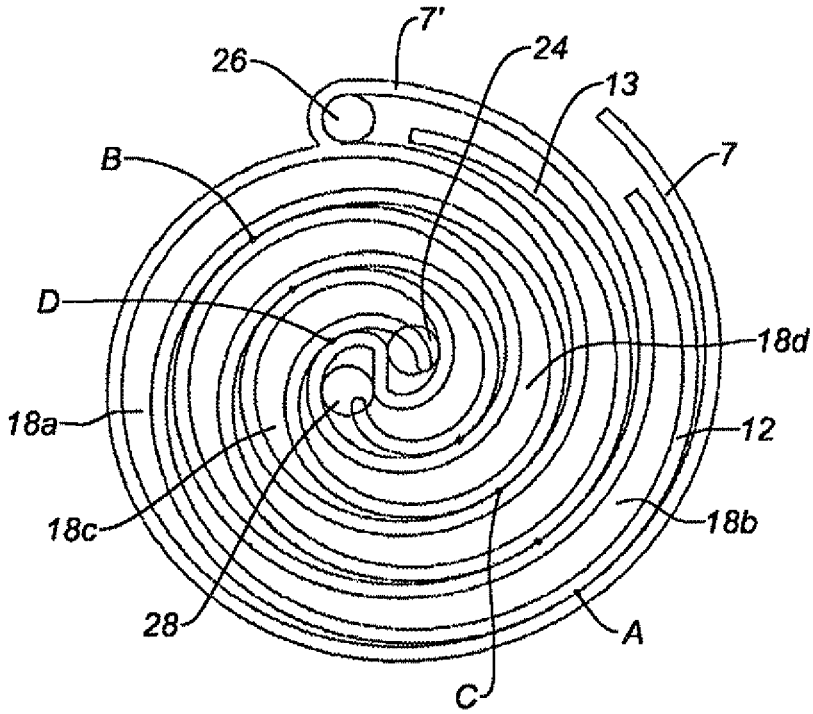
Figure 10:
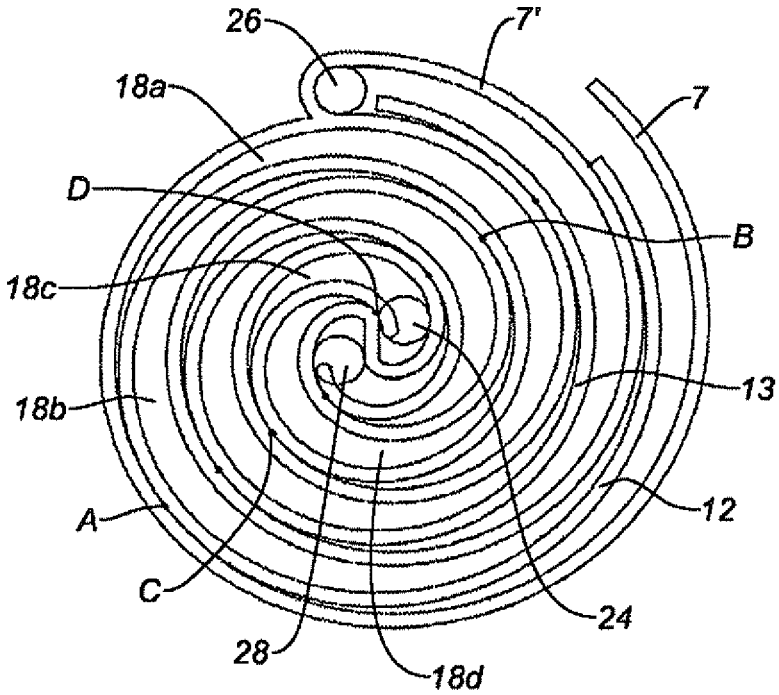
Figure 11:
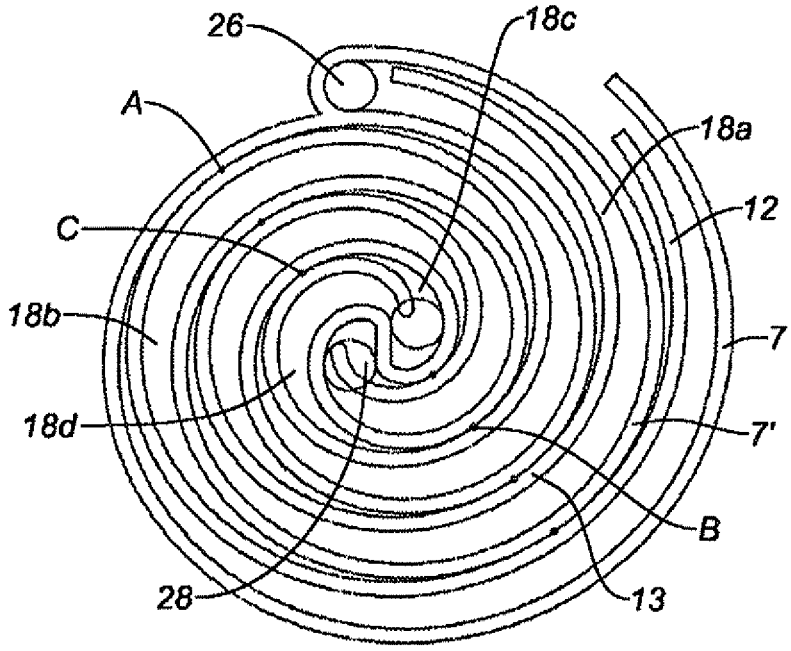

FIGS. 9 to 11 show three distinct operating positions of the scroll machine respectively offset by a quarter revolution relative to the position shown in FIG. 8. These different figures make it possible to view the evolution of the variable-volume chambers 18*a* to 18*d* of the first stage and points A to E during the orbital movement of the mobile volute casing 8.

Figure 12:
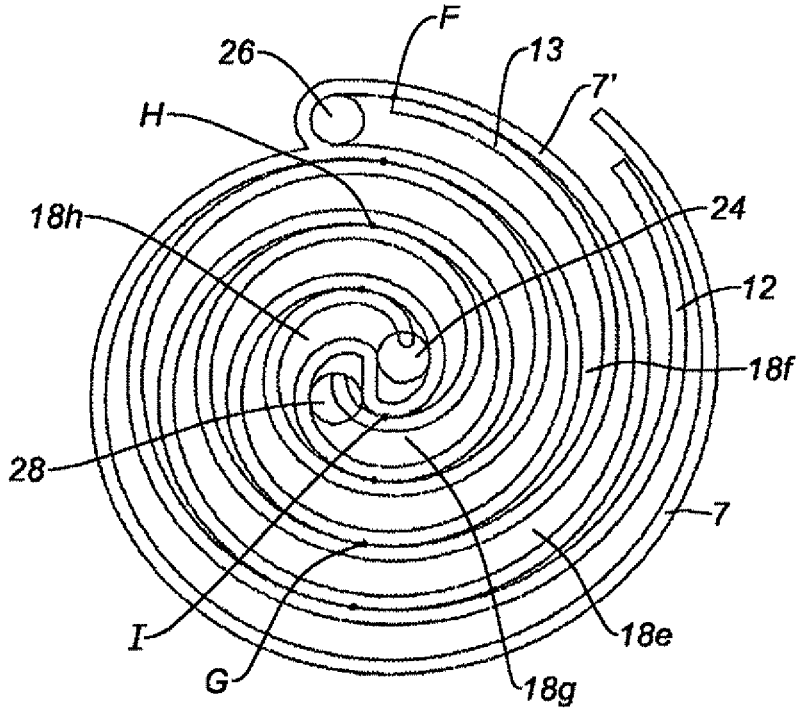
FIGS. 12 to 15 are transverse cross-sectional views of the volute casings of FIG. 7, in four distinct operating positions respectively offset by a quarter revolution.

FIG. 12 shows the scrolls of the fixed and mobile volute casings of FIG. 7 in angular positions so that the outer end of the scroll 13 of the mobile volute casing 8 defines the sealing line of one of the chambers of the second stage.

Points F to I shown in FIG. 12 show the sealing lines between the scroll 13 of the mobile volute casing 8 and the scrolls of the fixed volute casing 5, these sealing lines defining the variable-volume chambers of the second stage.

Figure 13:
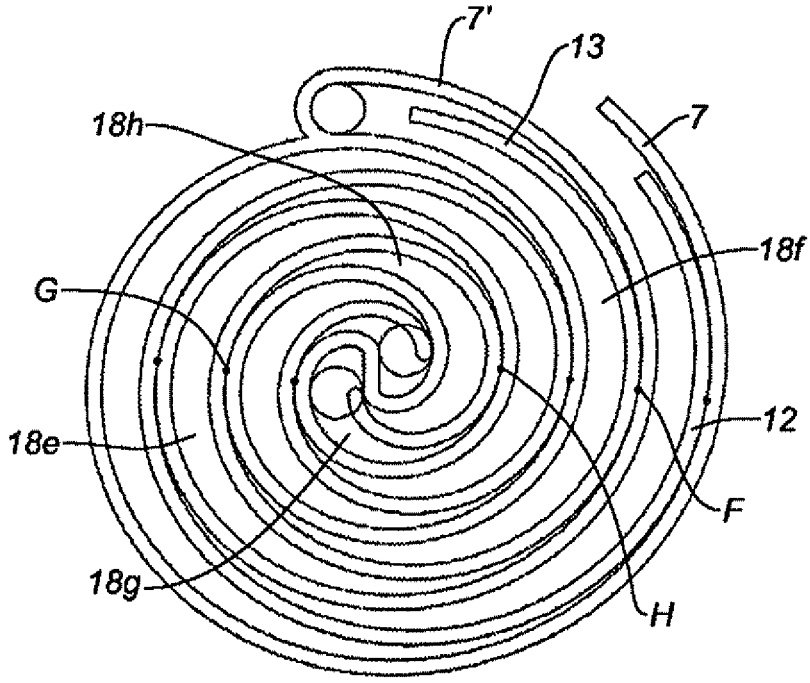
Figure 14:
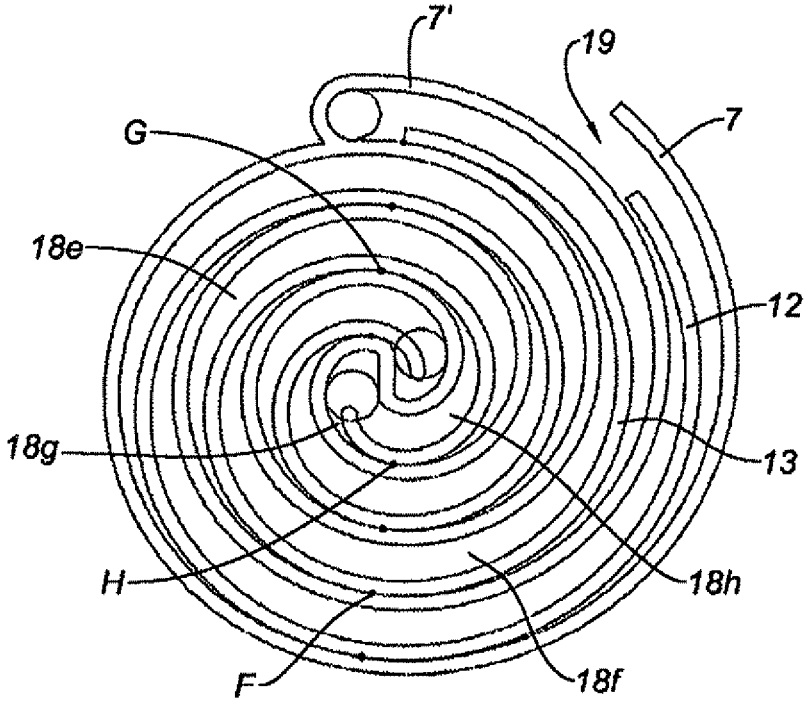
Figure 15:
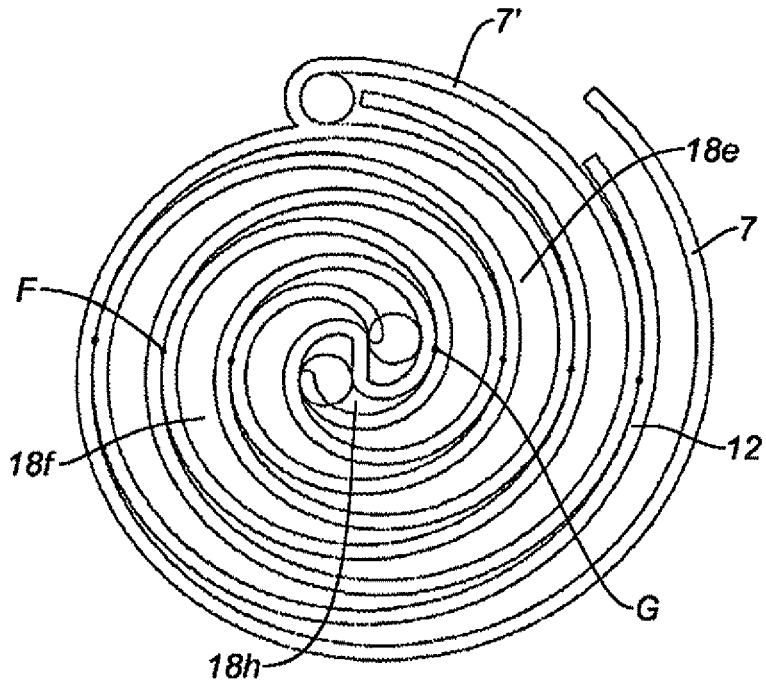

FIGS. 13 to 15 show three distinct operating positions of the scroll machine respectively offset by a quarter revolution relative to the position shown in FIG. 12. These different figures make it possible to view the evolution of the variable-volume chambers 18*e* to 18*h* and points F to I during the orbital movement of the mobile volute casing 8.

Figure 16:
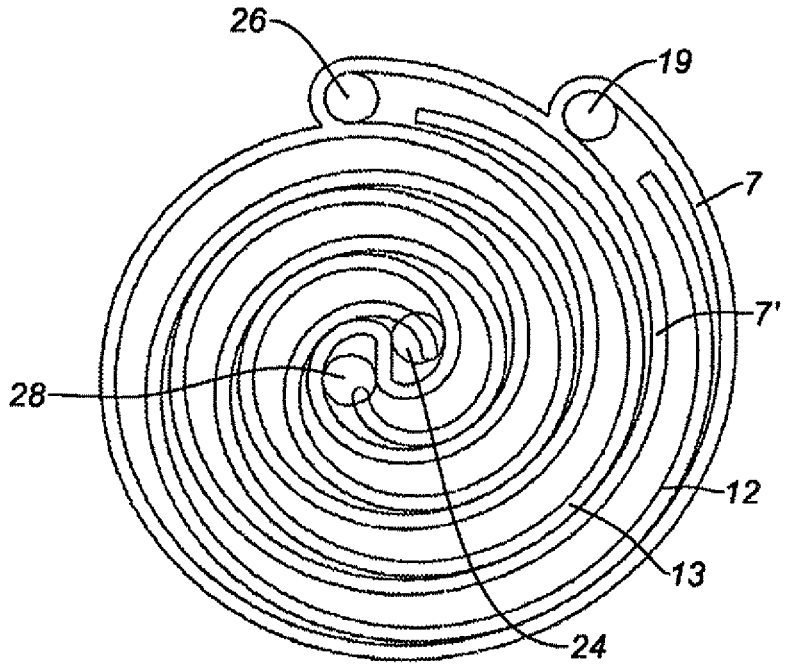
FIG. 16 is a transverse cross-sectional view of the fixed and mobile volute casings of a scroll machine according to a fifth embodiment.

FIG. 16 shows another alternative embodiment of the scroll machine that differs from that shown in FIG. 7 in that the outer end of the scroll 7 of the fixed volute casing 5 is connected to the outer wall of the scroll 7' of the fixed volute casing 5, and in that the first stage comprises a single fluid intake passage 19 constituted by a through orifice formed in the plate 6 of the fixed volute casing 5 and emerging at the outer end of the scroll 7 of the fixed volute casing 5. The through orifice 19 is arranged to open respectively into the outermost variable-volute chambers of the first stage during the orbital movement of the mobile volute.

Figure 17:
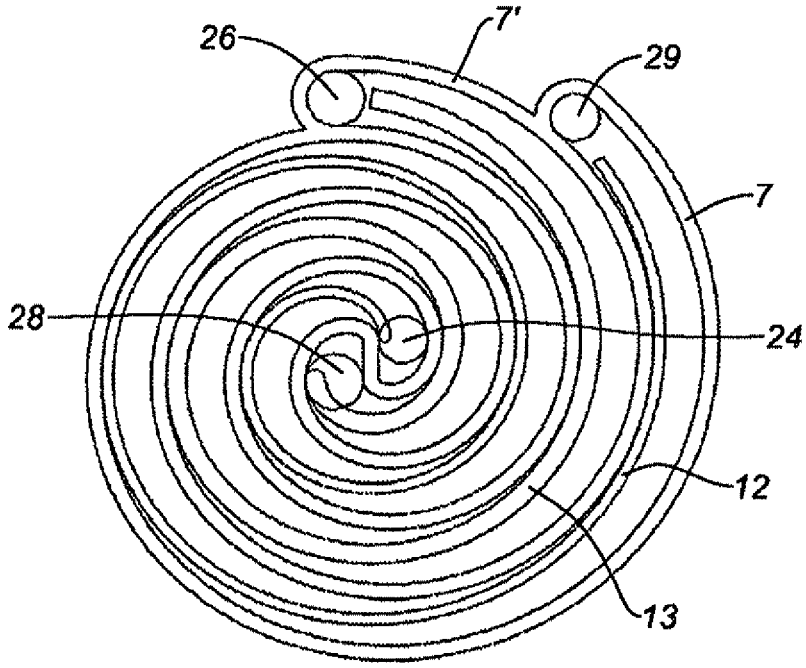
FIG. 17 is a transverse cross-sectional view of the fixed and mobile volute casings of a scroll machine according to a sixth embodiment.

FIG. 17 shows another alternative embodiment of the scroll machine that differs from that shown in FIG. 16 in that the scroll 12 of the mobile volute casing 8 has a smaller thickness than that of the scroll 13 of the mobile volute casing 8.

Figure 18:
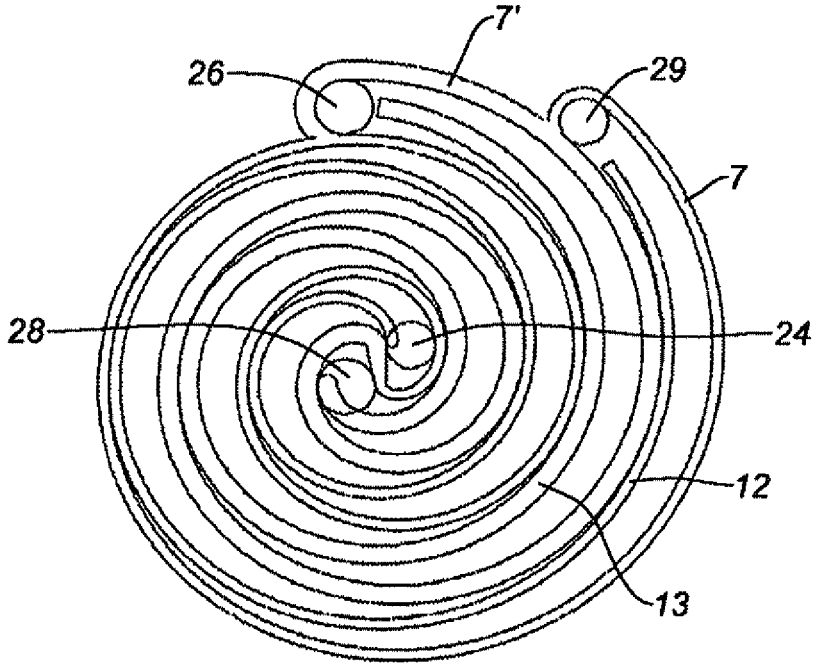
FIG. 18 is a transverse cross-sectional view of the fixed and mobile volute casings of a scroll machine according to a seventh embodiment.

FIG. 18 shows another alternative embodiment of the scroll machine that differs from that shown in FIG. 17 in that the scroll 7 of the fixed volute casing 5 has a thickness smaller than that of the scroll 7' of the fixed volute casing 5.

Figure 19:
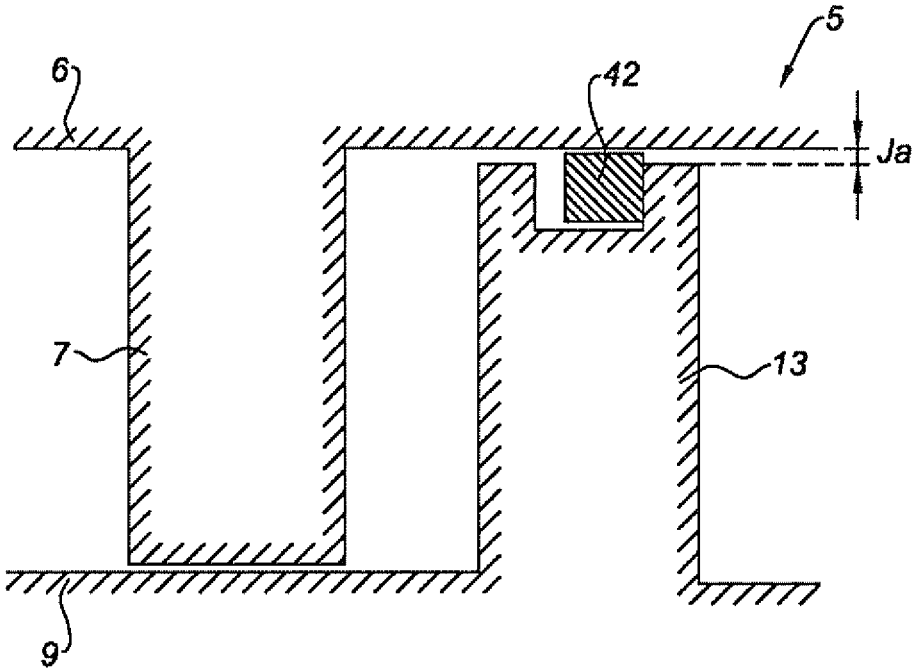
FIG. 19 is a partial cross-sectional view of the fixed and mobile volute casings of a scroll machine according to an eighth embodiment.

FIG. 19 shows still another alternative embodiment of the scroll machine that differs from that shown in FIG. 1 in that the fixed volute casing 5 and the scroll 13 of the mobile volute casing 8 are configured so that axial play Ja exists between the latter, and in that the scroll 13 of the mobile volute casing 8 includes, on its face oriented toward the plate 6 of the fixed volute casing, a sealing segment 42.

Figure 20:
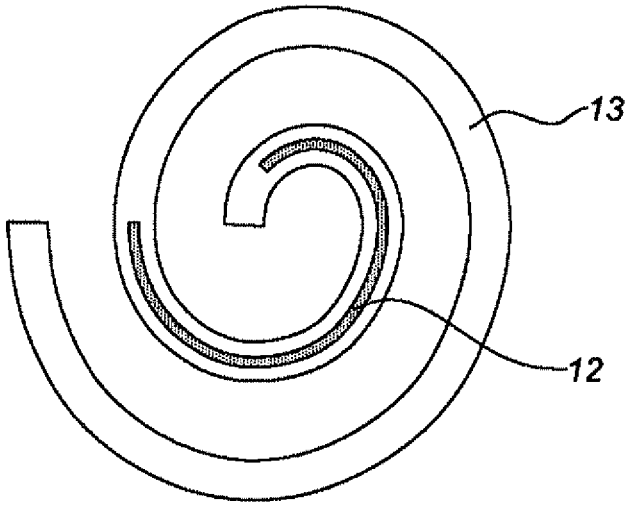
FIG. 20 is a top view of one of the scrolls of the mobile volute casing of FIG. 19.

As shown in FIG. 20, the sealing segment 42 extends only over the central portion of the scroll 13 of the mobile volute casing 8.

According to one alternative embodiment of the scroll machine not shown in the figures, the sealing segment 42 could extend over the entire length of the scroll 13 of the mobile volute casing.

According to still another alternative embodiment of the scroll machine not shown in the figures, the scroll 7 of the fixed volute casing 5 could also comprise, on its face oriented toward the plate 9 of the mobile volute casing 8, a sealing segment.

Figure 21:
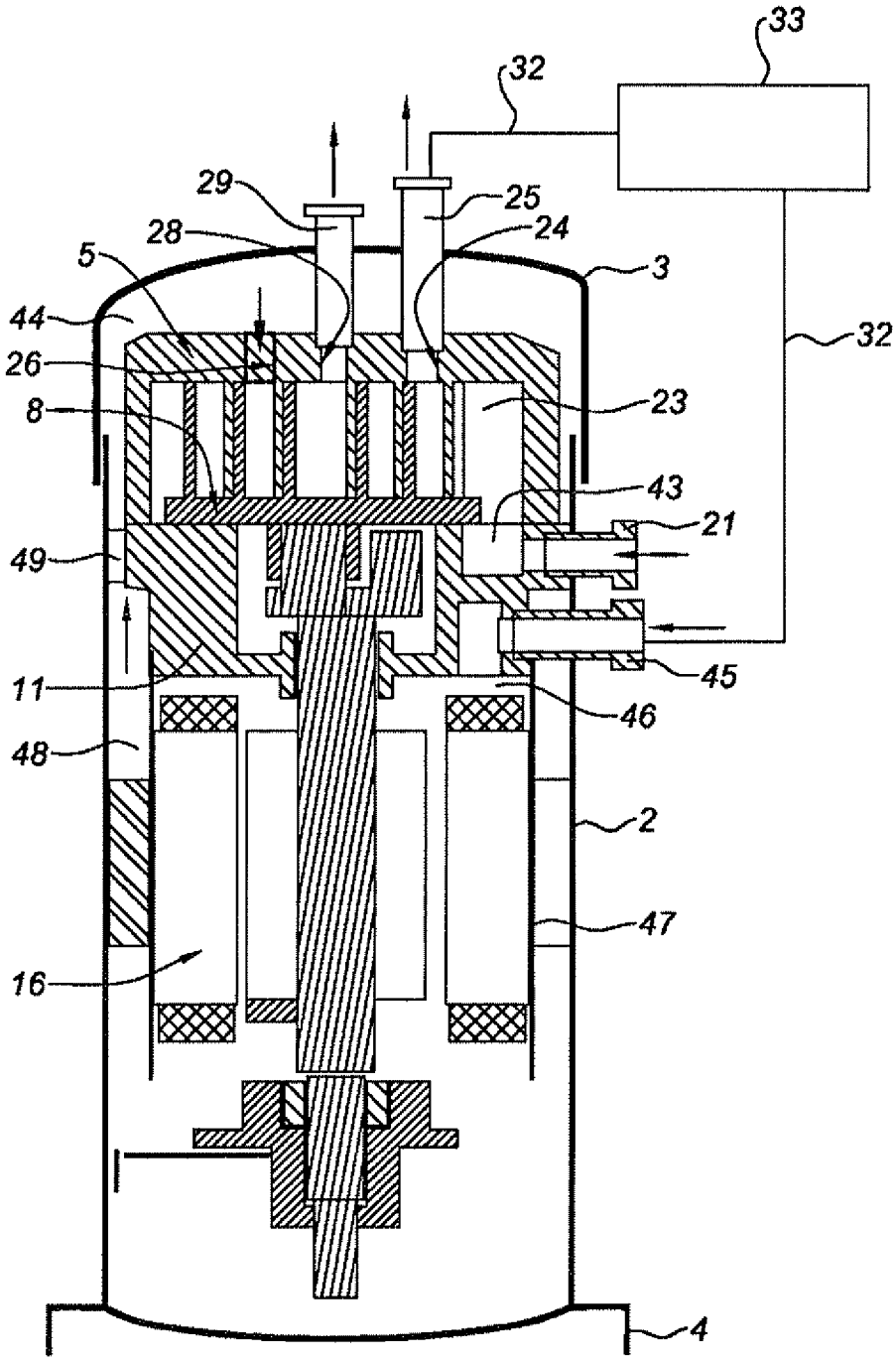
FIG. 21 is a diagrammatic longitudinal cross-sectional view of a scroll machine according to a ninth embodiment.

FIG. 21 shows still another alternative embodiment of the scroll machine that differs from that shown in FIG. 1 in that the coolant inlet 21 opens into an intake chamber 43 formed in the body 11 and communicating with the suction chamber 23 delimited by the fixed 5 and mobile 8 volute casings, in that the fluid intake passage 26 opens into a chamber 44 delimited by the lid 3 and the fixed volute casing 5, in that the coolant outlet 29 extends substantially parallel to the axis of the scroll machine, in that the fluid discharge passage 28 is directly connected to the coolant outlet 29, and in that the scroll machine comprises a connector 45 extending radially through the shroud 2 and opening into an intermediate chamber 46 delimited by the body 11, the motor 16 and a tubular jacket 47 surrounding the latter, the connector 45 being connected to the cooling means 33.

Under operating conditions of the scroll machine shown in FIG. 21, the compressed coolant discharged by the discharge orifice 24 is transported to the cooling means 33 via the coolant outlet 25 and one of the connecting portions 32.

The compressed fluid is cooled and is then transported to the connector 45 via the other of the connecting portions 32. The coolant passes into the intermediate chamber 46 and flows from top to bottom through the motor 16, in particular through a space situated between the rotor and the stator thereof. The coolant then flows from bottom to top in the annular volume 48 delimited by the tubular jacket 47 and the shroud 2 as far as the chamber 44 via at least one peripheral passage 49 formed between the shroud 2 and the body 11. The coolant then reaches the intake orifice 26 of the second stage, so it can be compressed in the variable-volume chambers of the second stage.

Such a circulation of the coolant between the two compression stages improves the cooling of the motor, since the latter is cooled by a higher-density gas. Furthermore, as a result of such a circulation of the coolant between the two compression stages, the part of the scroll machine housing the motor 16 is at a pressure substantially identical to that of the coolant discharged by the discharge orifice 24 of the first compression stage, therefore at a greater pressure relative to the embodiment shown in FIG. 1. This results in a decrease in the pressure difference between the peripheral chambers of the second stage and the part of the scroll machine housing the motor 16, which makes it possible to reduce leaks between these peripheral pockets of the second stage and the part of the scroll machine housing the motor 16. This decrease in the pressure difference between the peripheral chambers of the second stage and the part of the scroll machine housing the motor 16 also makes it possible to limit the forces exerted on the plate of the mobile volute casing, therefore to limit the wear of the latter.

Furthermore, such a circulation of the coolant between the compression stages improves the volumetric and isentropic output of the scroll machine because the coolant flows directly into the first compression stage, without being deteriorated by its passage through the motor 16.

Figure 22:
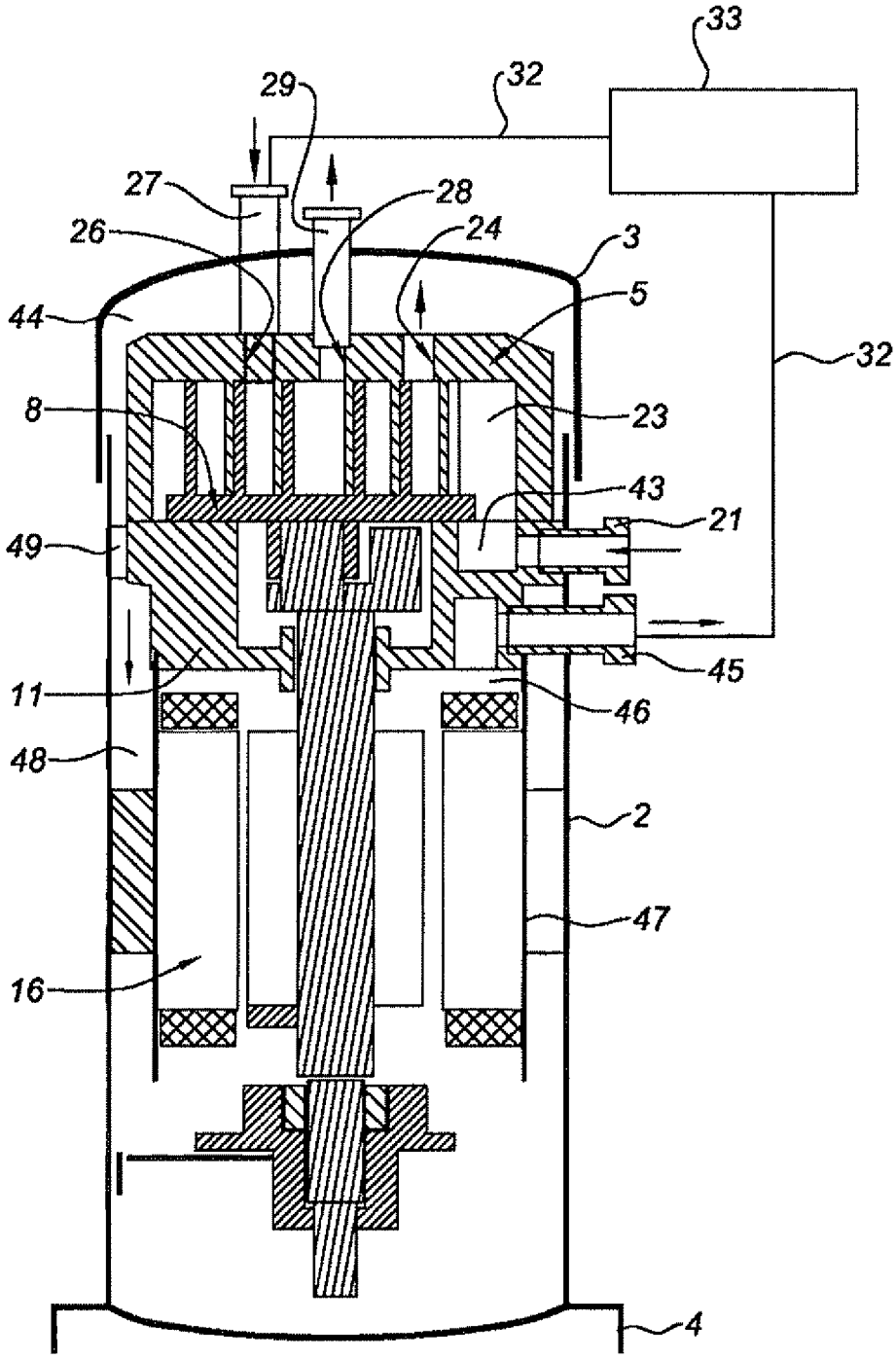
FIG. 22 is a diagrammatic longitudinal cross-sectional view of a scroll machine according to a tenth embodiment.

FIG. 22 shows still another embodiment of the scroll machine that differs from that shown in FIG. 21 in that the fluid intake passage 24 opens into the chamber 44 delimited by the lid 3 and the fixed volute casing 5, and in that the fluid intake passage 26 is connected to a coolant inlet 27 formed in the lid 3.

Under operating conditions of the scroll machine shown in FIG. 22, the compressed coolant discharged by the discharge orifice 24 enters the chamber 44 delimited by the lid 3 and the fixed volute casing 5, and flows from top to bottom in the annular volume 48 delimited by the tubular jacket 47 and the shroud 2 via the peripheral passage 49. The coolant then flows from bottom to top through the motor 16, as far as the intermediate chamber 46. Then, the coolant is transported as far as the cooling means 33 via the connector 45 and one of the connecting portions 32.

The compressed coolant is cooled and is then transported as far as the intake orifice 26 of the second stage via the other of the connecting portions 32 and the coolant inlet 27.

Such a circulation of coolant between the two compression stages improves the cooling of the engine, since the latter is cooled by a higher-density gas, and previously cooled.

According to one embodiment of the invention not described in the figures, the scroll machine could be configured to operate as a scroll expansion machine, like a scroll turbine. In that case, the intake passages would be discharge passages, the discharge passes would be intake passages, and the coolant would be intended to be expanded successively in the second stage and in the first stage.

The invention is of course not limited to only the embodiments of this scroll machine described above as examples, but on the contrary encompasses all alternative embodiments.

The invention claimed is:

1. A multi-stage scroll machine intended to compress and/or expand a fluid, comprising:

first and second volute casing describing an orbital relative movement, the first volute casing being equipped with at least one scroll and the second volute casing being equipped with at least one first scroll and at least one second scroll, the at least one first scroll of the second volute casing being engaged in the scroll of the first volute casing so as to delimit at least a first series of variable-volume chambers belonging to a first compression or expansion stage, and the at least one second scroll of the second volute casing being engaged in the scroll of the first volute casing so as to delimit at least one second series of variable-volume chambers belonging to a second compression or expansion stage, each compression or expansion stage comprising at least one high-pressure fluid passage arranged to open into at least one of the chambers of the respective stage and at least one low-pressure fluid passage arranged to open into at least one of the chambers of the respective stage, the high-pressure fluid passage of the first stage and the high-pressure fluid passage of the second stage being configured so that the fluid passing through the high-pressure fluid passage of the first stage has a lower pressure than that of the fluid passing through the high-pressure fluid passage of the second stage or, the lower-pressure fluid passage of the first stage and the low-pressure fluid passage of the second stage being configured so that the fluid passing through the low-pressure fluid passage of the first stage has a pressure lower than that of the fluid passing through the low-pressure fluid passage of the second stage, wherein a portion of the low-pressure fluid passage of the second stage that is arranged to open into at least one of the chambers of the second stage is further from a first convergence zone of the scrolls delimiting the variable-volume chambers of the second stage than a portion of the high-pressure fluid passage of the first stage that is arranged to open into at least one of the chambers of the first stage, the first convergence zone being located at a center portion of the first volute casing; and wherein the at least one first scroll and the at least one second scroll of the second volute overlap one another so that, according to at least one radial cross-section of the second volute casing along a radius in which the at least one first scroll and the at least one second scroll overlap, at least one alternation of the at least one first scroll and the at least one second scroll of the second volute casing is achieved from a second convergence zone of the at least one first scroll and the at least one second scroll of the second volute casing, the second convergence zone being located at a center portion of the second volute casing.

2. The machine according to claim 1, wherein the variable-volume chambers of at least one of the stages have a different height from that of the variable-volume chambers of the other stages.

3. The machine according to claim 1, wherein at least one of the scrolls of the second volute casing has a different height from that of the other scrolls of the second volute casing.

4. The machine according to claim 1 wherein the first volute casing and one of the scrolls of the second volute casing are configured so that axial play exists between the latter parts, and said scroll of the second volute casing includes, on its face oriented toward the first volute casing and on at least a portion of its length, a sealing segment.

5. The machine according to claim 1, wherein at least one of the scrolls of the second volute casing has a different thickness from that of the other scrolls of the second volute casing.

6. The machine according to claim 1, wherein at least one of the scrolls of the second volute casing has a longitudinally variable thickness.

7. The machine according to claim 1, further comprising a connecting member configured to connect the high-pressure fluid passage of the first stage and the low-pressure fluid passage of the second stage, on the one hand, and heater or cooler arranged to heat or cool the fluid flowing between the high-pressure fluid passage of the first stage and the low-pressure fluid passage of the second stage, on the other hand.

8. The machine according to claim 1, wherein each scroll of the second volute casing partially delimits the variable-volume chambers of a single stage.

9. The machine according to claim 8, wherein the outer end of the scroll of the first volute casing and the outer end of the at least one first scroll of the second volute casing partially delimiting the variable-volume chambers of the first stage are situated asymmetrically relative to the convergence zone of the scrolls delimiting the variable-volume chambers of the second stage, and in that the balancing means include a portion of the scroll of the first volute casing extending between a point diametrically opposite the outer end of the scroll of the second volute casing partially delimiting the variable-volume chambers of the first stage relative to the convergence zone of the scrolls delimiting the variable-volume chambers of the second stage and the outer end of the scroll of the first volute casing.

10. The machine according to claim 1, wherein the scroll machine is a scroll compressor, in that the low-pressure fluid passages of the different stages are fluid intake passages, in that the high-pressure fluid passages of the different stages are fluid discharge passages, and in that the fluid is intended to be compressed successively in the first stage and in the second stage.

11. The machine according to claim 10, wherein at least one of the stages comprises two variable-volume chambers, called outer chamber and inner chamber, delimited inwardly and outwardly, respectively, by one of the scrolls of the second volute casing and arranged to open into the high-pressure fluid passage of the corresponding stage, and in that the machine comprises pressure balancing means configured so that the pressure of the fluid in the outer chamber, before it is put in communication with the high-pressure fluid passage of the corresponding stage, is substantially equal to the pressure of the fluid in the inner chamber before it is put in communication with the high-pressure fluid passage of the corresponding stage.

12. The machine according to claim 11, wherein the pressure balancing means include a protrusion extending from the inner surface of the scroll of the first volute casing and situated at the high-pressure fluid passage of the corresponding stage.

13. The machine according to claim 1, wherein the scroll machine is a scroll expansion machine, in that the low-pressure fluid passages of the different stages are fluid discharge passages, in that the high-pressure fluid passages of the different stages are fluid intake passages, and in that the fluid is intended to be expanded successively in the second stage and in the first stage.

14. The machine according to claim 1, wherein the first volute casing is fixed and the second volute casing is mobile.

* * * * *